US006159030A

United States Patent [19]

Gawron et al.

[11] Patent Number: 6,159,030

[45] Date of Patent: Dec. 12, 2000

[54] SELF-ALIGNING CONNECTING SYSTEM

[75] Inventors: Steven F. Gawron, Dearborn; Jeffrey A. Branch, Eastpointe, both of Mich.

[73] Assignee: Lear Automotive Dearborn, Inc., Southfield, Mich.

[21] Appl. No.: 08/876,877

[22] Filed: Jun. 16, 1997

[51] Int. Cl.[7] ..... H01R 13/64

[52] U.S. Cl. ..... 439/247

[58] Field of Search ..... 439/246, 247, 439/248, 252; 29/41, 52, 54; 248/128; 269/37; 108/103; 74/16

[56] References Cited

U.S. PATENT DOCUMENTS

| | | | |
|---|---|---|---|
| 4,815,986 | 3/1989 | Dholoo | 439/248 |
| 4,954,085 | 9/1990 | Inoue et al. | 439/248 |
| 5,112,154 | 5/1992 | Milam | 403/13 |
| 5,259,779 | 11/1993 | Ooya et al. | 439/247 |
| 5,383,790 | 1/1995 | Kerek et al. | 439/248 |
| 5,642,563 | 7/1997 | Bonnett | 29/248 |
| 5,893,768 | 4/1999 | Gawron et al. | 439/248 |
| 5,915,985 | 6/1999 | Fabian et al. | 29/248 |
| 5,971,784 | 10/1999 | Fabian et al. | 439/224 |

OTHER PUBLICATIONS

U.S. Patent Application #08/768,725 "Self–Aligning Connection System" Steven F. Gawron et al., Filed Dec. 18, 1996.

*Primary Examiner*—Brian Sircus
*Assistant Examiner*—Barry M. L. Standig
*Attorney, Agent, or Firm*—MacMillan Sobanski & Todd, LLC; A. Michael Tucker

[57] ABSTRACT

A connection system comprises a connector having a transversely extending ridge on a side thereof. A holder has a wall structure for receiving the connector. The wall structure includes a channel and a side wall. The side wall includes a movable leg having a leg ridge. The leg ridge divides the channel into a first zone and a second zone. When the connector is within the first zone, the connector cannot move along a first axis. When the connector is within the second zone, the connector can move along the first axis. If a predetermined force is exerted on the connector, the connector of the holder engages the leg connector to cause the leg to flex outwardly allowing the connector to move between the first and second zones.

8 Claims, 3 Drawing Sheets

FIG. 1
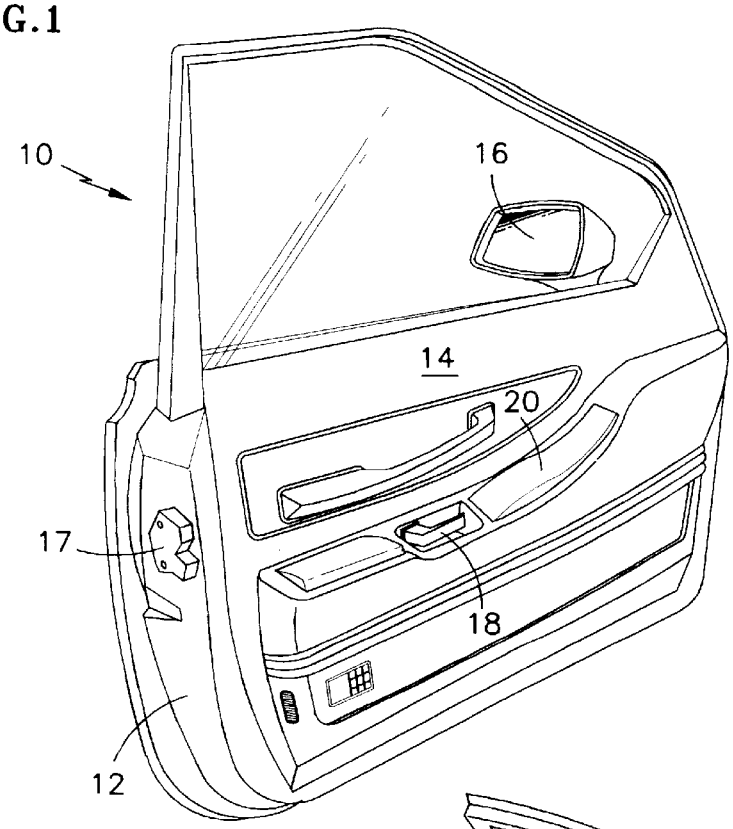
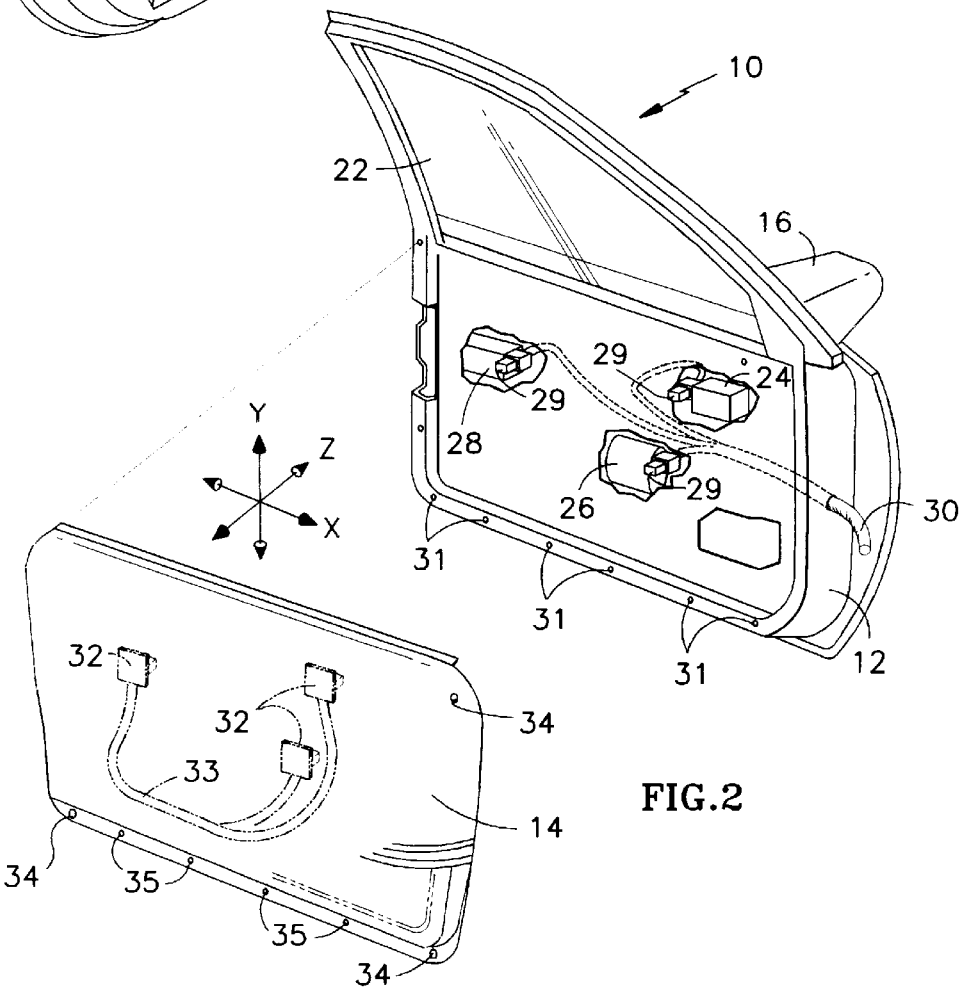
FIG. 2

FIG.5
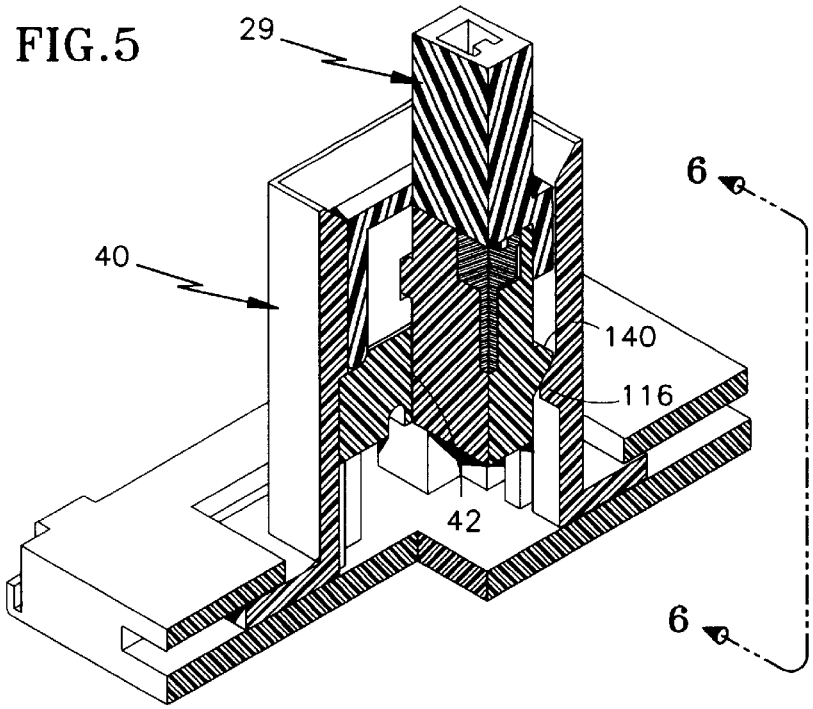
FIG.6
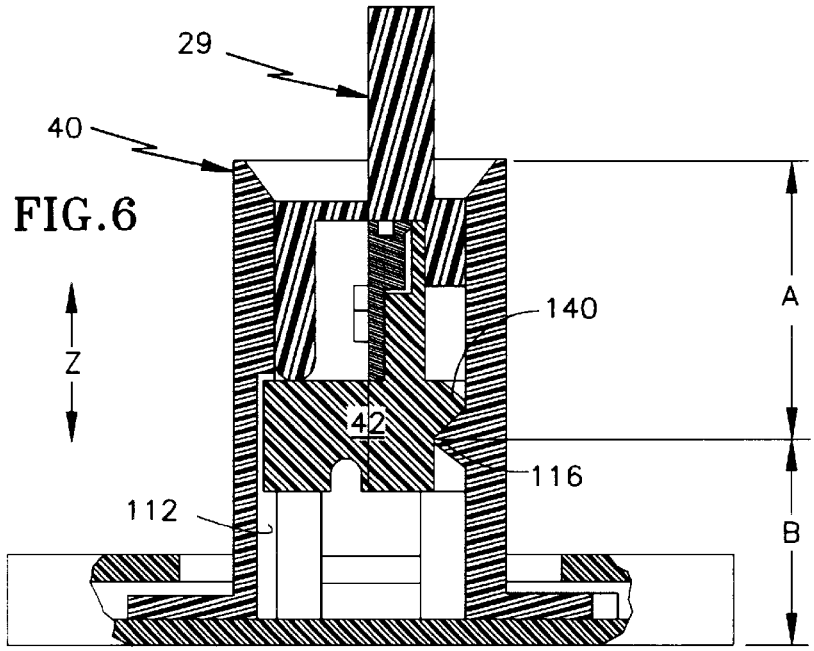
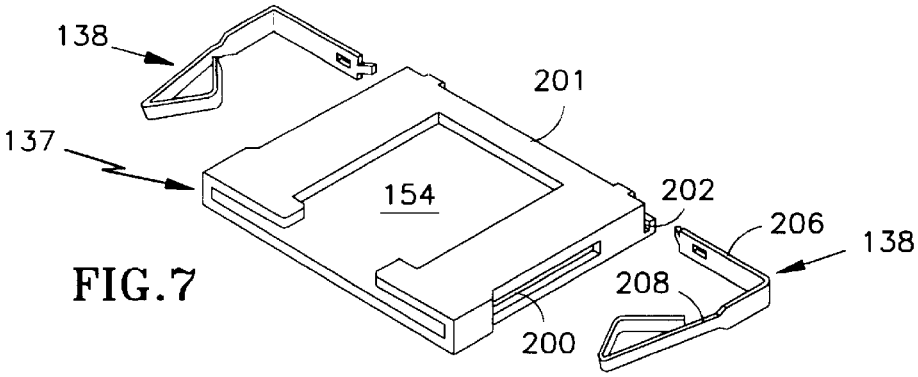
FIG.7

SELF-ALIGNING CONNECTING SYSTEM

TECHNICAL FIELD

The present invention relates to a vehicle door wiring system, and more particularly to a self-aligning connection system for making the electrical connections within the vehicle door wiring system.

BACKGROUND OF THE INVENTION

Vehicle doors generally include a metal door frame connected to an interior trim panel. A wire harness is attached to the frame, and a wire harness is attached to the panel. The frame wire harness includes a plurality of male connectors and the panel wire harness includes a plurality of female connectors. In order to complete a circuit, each female connector must be mated with the corresponding male connector. In this way, electrical signals may be communicated between components on the door and accessories remote from the door.

Currently, a worker is required to properly mate the connectors prior to the panel being mounted to the door frame. The frame and panel must be close enough to mate the connectors. The worker must reach around the panel and into the narrow space between the frame and panel to make these connections. Since the worker cannot see the connections as they are being made, the whole process becomes not only cumbersome and inconvenient, but also problematic.

A first problem is that the electrical connection maybe unsatisfactory. Some or all of the affected electrical components may work sporadically if at all. For example, a partial connection may occur, a terminal maybe damaged, or the connection may separate.

A second problem is that during assembly, the assembler may need to pull on the wires in order to make and/or check connections. This may damage or cut wires, which in turn can affect the performance of the electrical components.

A third problem is that the mated connectors may be free to move within the door, which results in undesirable noise during vehicle use.

A fourth problem is in a manufacturing setting minimizing assembly time of the panel to the door frame is desired. The current process does not keep the assembly time to the desired level since it is an extremely difficult operation.

Systems have been proposed wherein plug-in electrical connections are completed as the panel is being moved towards the door. Since this would not require the worker to reach around the panel, this would be an improvement. However, such systems have required exact alignment between the two electrical connectors, which is difficult to achieve.

Therefore, a connection system is sought, which does not require precise alignment of connectors for them to be connected while assembling a door of a vehicle. It is desired that the system be robust and manufacturable.

SUMMARY OF THE INVENTION

According to one embodiment of the present invention, a connection system for mating and aligning a first and a second connector is disclosed. The connection system includes a holder and a base. The holder houses the first connector. The housing has a means for permitting the first connector to move along a first axis relative to the holder, if a predetermined mating force is exerted thereupon. The base has a cavity for holding the holder. The cavity is dimensioned to permit the holder to move along a second and/or third axis. The connection system allows the first connector therein to self-align with the second connector during installation of the panel to the frame.

In one embodiment, the connection system further includes two flexible spring. Each springs has a rounded protrusion. Each of the springs is disposed within the cavity of the base in a spaced apart relationship, so that the protrusions extend into the cavity. The holder includes a platform having a rounded indentation on opposite sides. Upon installing the holder into the base, the springs engage each of the indentations on the holder. Compression of the springs allows the holder to move along a second axis. Movement of the protrusions along the indentations allows movement in along a third axis.

The foregoing invention will become more apparent in the following detailed description of the best mode for carrying out the invention and in the accompanying drawings.

BRIEF DESCRIPTION OF THE DRAWINGS

FIG. 1 is a partial perspective view of a fully assembled automobile door.

FIG. 2 is a perspective, exploded schematic view of the door in FIG. 1.

FIG. 5 is a fragmentary perspective view of the connection system of FIG. 3 with a portion broken away for clarity, the connection system is in an assembled mode with a female connector in an initial position.

FIG. 6 is a cross-sectional view of the connection system along line 6—6 of FIG. 5.

FIG. 7 is a perspective view of another embodiment of a base and springs of the present invention.

BEST MODE FOR CARRYING OUT AN EMBODIMENT OF THE INVENTION

Figures 3, 4:
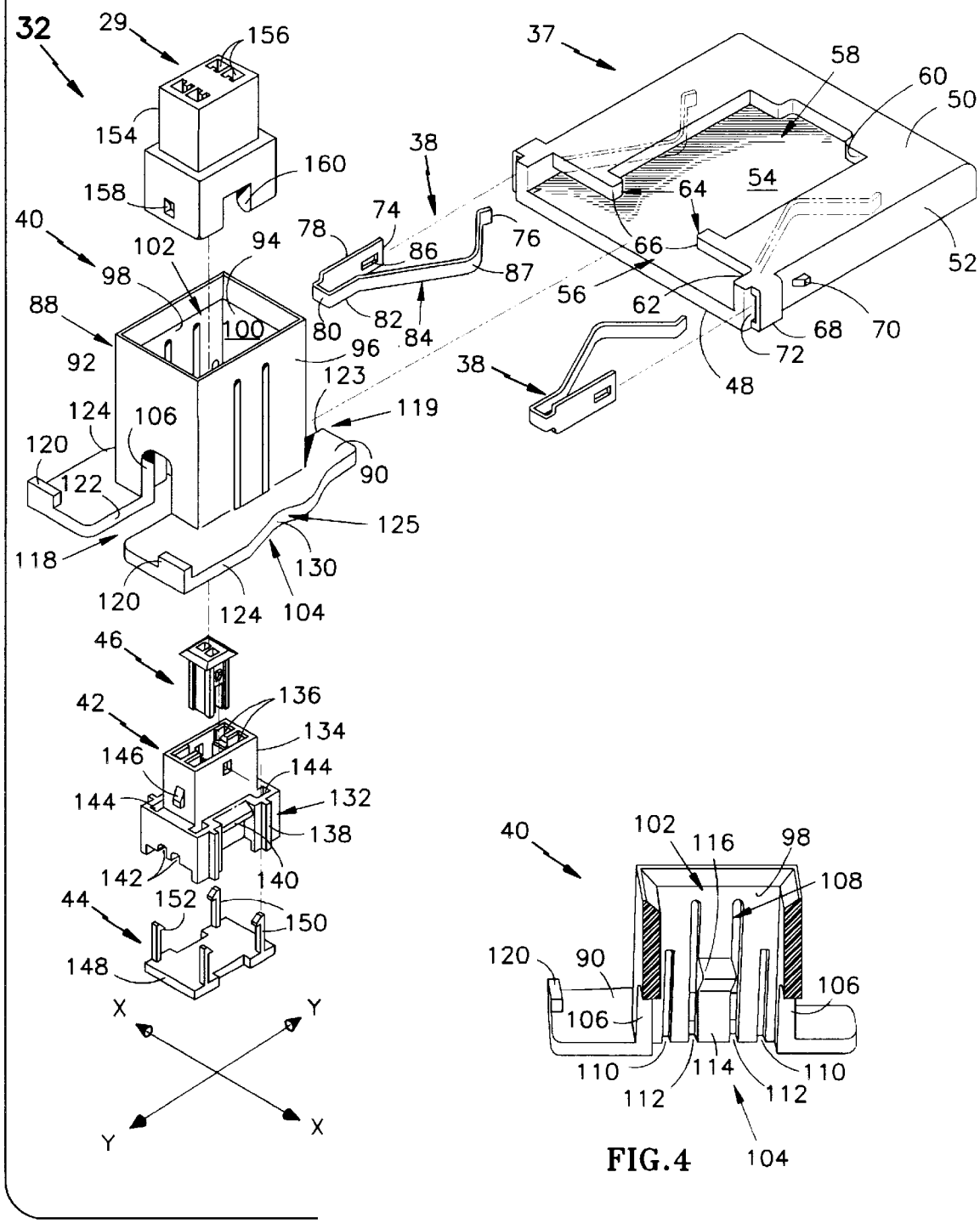
FIG. 3 is an enlarged exploded view of a connection system of the present invention.
FIG. 4 is an enlarged view of a holder having a portion broken away for clarity.

Referring to FIG. 1, a typical automobile door 10 includes a door frame 12 supporting an interior trim panel 14.

The frame 12 provides structural support for the panel 14, and impact protection for the passengers. The exterior of the frame 12 is typically designed to house a mirror 16, and a door lock 17.

In current practice, a number of electrical and mechanical components are usually preassembled on the interior of the frame 12, the panel 14, and the vehicle interior.

The interior panel 14 presents a finished, aesthetically pleasing surface and usually includes a door handle 18, and an electrical control panel 20 for actuating a window 22 (as shown in FIG. 2).

Referring to FIG. 2, as an example, a mirror connection 24, a window motor 26 and a door latch 28 are received in the frame 12. The electric components 24, 26, and 28 are provided with male connectors 29 fixed at set locations. A wire harness 30 electrically interconnects the connectors 29 and is mounted within the frame 12. The periphery of the frame has multiple holes 31 formed therein.

On the panel 14, electric components, such as a mirror actuator (not shown), the electronic control panel 20 (as shown in FIG. 1), and a door latch switch (not shown) have associated therewith a connection system 32 (as shown in phantom). The details of the electric components, mechanical components and circuitry are as known in the art. Each connection system 32 is mounted on the interior surface of the panel 14. A wire harness 33 electrically interconnects the connection systems 32, and is mounted on and carried by the panel 14. A plurality of alignment pins 34 and fasteners 35 are disposed about the periphery of the panel 14.

Typically, the reference axis system associated with the door 10 has three axes. The x-axis of the system extends across the width of the door 10, and is represented by an arrow X. The y-axis of the system extends across the height of the door 10, and is represented by an arrow Y. The z-axis of the system extends perpendicular to the door across the width of the car, and is represented by an arrow Z.

Referring to FIGS. 3 and 4, the connection system 32 includes a base 37, two springs 38, a holder 40, a female connector 42, a wire dress member 44, and a wedge 46.

The base 37 removably retains the holder 40 therein as will be discussed herein.

The base 37 is substantially rectangular and is formed by a first face 48, a second face 50 spaced from the first face 48, and a plurality of integral sidewalls 52 which extend between and join the faces 48 and 50. The base 37 further includes a cavity 54 therein. The cavity 54 has an opening 56.

The base 37 is positively retained to the panel 14 (as shown in FIG. 2). The first face 48 is mounted thereto using sonic or ultrasonic welding or molded integrally therewith.

The second face 50 has a centrally disposed T-shaped cutout 58. The T-shaped cutout 58 includes a retaining or narrow end 60, a releasing or enlarged end 62, and a neck 64 interconnecting these ends. Opposing protrusions 66 extend inwardly on neck 64.

The two opposed side walls 52 further include a c-shaped wall structure 68 and a wedge shaped projection 70. The wall structure 68 is formed adjacent the cutout retaining end 62, and defines a passageway 72. The projection 70 extends from the side wall rearward of the wall structure 68.

The springs 38 are bent metal components. Each spring 38 has a first end 74 and a second end 76. Each spring 38 further includes a plurality of integrally formed portions 78, 80, 82, and 84. The first portion 78 is flat and includes a hole 86 near the first end 74. The hole 86 is shaped to mate with the wedged projection 70. The second portion 80 joins the first and third portions 78 and 82 and is bent so that the first and third portions 78 and 82 are substantially parallel to one another.

The fourth portion 84 extends from the third portion 82 and is curved to form a rounded projection 87 spaced from the second end 76.

The holder 40 includes a box-shaped wall structure 88 and a platform 90 integrally formed therewith. The wall structure 88 is formed by a plurality of integral first, second, third and fourth sidewalls 92, 94, 96, and 98, respectively. The first and second side walls 92 and 94 are spaced and parallel to one another. The third and fourth side walls 96 and 98 are spaced and parallel to one another.

The side walls define an open-ended channel 100 therethrough. The channel first end 102 is spaced from the second end 104. Each of the side walls are chamfered at the first end 102 to guide the male connector 29 into the channel 100.

The first and second side walls 92, 94 include a U-shaped cutout 106 open at one end.

Referring to FIG. 4, the third and fourth side walls 96 and 98 have the same features which are the means for permitting the female connector 42 to move along the x-axis. The features of the fourth side wall 98 are shown. Each side wall 96,98 includes a central movable leg 108 and two grooves 110.

The central movable leg 108 is formed by cutting slots 112 on either side of the leg 108, which start at the second end 104 and extend longitudinally therefrom. The slots 112 are partially longitudinally extending, so that the leg free end 114 is movable.

The leg 108 includes an angled ridge 116 spaced from the free end 114. The ridge 116 extends transversely across the leg 108 and protrudes into the channel 100.

The grooves 110 are disposed on either side of the leg 108 and extend partially longitudinally along the wall 98.

Referring to FIG. 3, the platform 90 is formed about the second end 104 of the wall structure 88. The platform 90 includes a proximal end 118, a distal end 119 spaced from the proximal end, two projections 120, two slots 122 and 123, and two contoured edges 124.

The projections 120 extend upward at the platform's proximal end 118. The slot 122 extends between the projections 120 from the proximal end 118 to the cutout 106. The slot 123 extends from the wall 94 to the distal end 119. The cutouts 106 and the slots 122 123 act as a pass through for the wires (not shown).

The contoured edges 124 are shaped to form a rounded indentation 125, which is shaped to mate with the spring rounded projection 87. The valley 130 of the indentation is between the sloped edges.

The female connector 42 includes a base 132, a tower 134, and channels 136.

The base 132 includes pairs of ribs 138, ridges 140, cutouts 142, and a plurality of channels 144. Pairs of spaced ribs 138 extend longitudinally along opposite sides of the base 132. The ridge 140 extends laterally between each pair of ribs 138. The lower surface of the base 132 includes transversely extending cutouts 142 for receiving the wires (not shown). One channel 144 extends longitudinally through the base 132 near each corner.

The tower 134 extends from the base 132. The tower 134 includes two tabs 146 (only one being shown). Each tab 146 projects from the associated sidewall of the tower 134.

The channels 136 extend longitudinally through the base 132 and the tower 134. Each channel 136 is configured to receive a female terminal (not shown) having a wire attached thereto.

The wire dress member 44 includes a substantially rectangular base 148 and a plurality of integral fingers 150. One finger extends perpendicularly from each corner of the base 148. The free end of each finger 150 includes a projection 152.

The wedge 46 is constructed to fit into the internal channels 136 in the female connector 42, in order to secure the terminals (not shown) therein.

The connection system 32 is for use with male connectors 29. The male connector 29 is a stepped housing 154. The housing 154 includes channels 156, holes 158, and cutouts 160.

The channels 156 extend longitudinally and receive terminals (not shown) having wires attached thereto. The holes 158 for mating with the tabs 146 on the female connector 42. The cutouts 160 in opposite side walls open downwardly at the lower surface.

The base 37, holder 40, female connector 42, wire dress member 44, the wedge 46, and male connector 29 may be molded from plastic using known techniques. The springs 38 may be formed from a metal such as cold roll steel using known techniques.

Use of the connection system 32 will now be discussed. Referring to FIG. 2, within the assembly plant the preassembled frame 12 has the electrical components shown located thereon. The wire harness 30 is formed having the male connectors 29 (as shown in FIG. 3) attached thereto. Each connector 29 has the four required terminals (not shown) secured therein. The panel 14 has the bases 37 (as shown in FIG. 3) coupled thereto.

Assembly of the connection system 32 will now be discussed with reference to FIG. 3. The springs 38 are attached to the base 37 by passing the first portion 78 through the channels 72, and engaging the hole 86 with the projection 70. Thus, the springs 38 are retained to the base 37. The springs 38 are spaced apart from one another. Once attached, the curved projection 87 extends into the center of the cavity 54 (as shown in phantom).

The terminals (not shown) are disposed within the channels 136 in the female connector 42. The wires attached to terminals, and the wires are disposed in the cutouts 142. The wire dress member 44 is mated with the female connector 42 to assure wire position. The wire dress fingers 150 are disposed within into the channels 144 of the female connector. The finger projections 152 releasibly retain the wire dress member to the connector 42. The wedge 46 is inserted into the channels 136 to retain the terminals therein.

Referring to FIGS. 3–6, The female connector 42 is inserted into the holder channel 100 using the second end 104. The ribs 138 mate with the grooves 110 in the walls 96 and 98. As the connector is inserted, the ridge 140 causes the leg 108 to flex outward, until the ridge 140 is above the ridge 116.

The female connector is within zone A, where it is not free to move along the Z axis. The engagement of the grooves 110 with the ribs 138 prevent movement toward the first end 102. The engagement of the ridge 140 with the ridge 116 prevents movement toward the second end 104. This is the initial position of the female connector.

Referring to FIG. 3, the holder 40 is disposed within the base 37. The platform 90 is inserted into the cavity 54 through the opening 56. The wall structure 88 passes through the neck 64 into the retaining end of the cutout 60. The proximal end 18 cannot be inserted into the opening 56 due to the projections 120, thus the design assures correct assembly of the system. The base protrusions 66 initially align the holder 40 as it is inserted, and prevent damage to the springs 38 during this insertion.

In its initial position, the holder 40 is disposed between the springs. Once fully inserted, the rounded projections 87 mate with the rounded indentations 125. The holder is centered within the base 37.

Referring to FIG. 2, each base 37 supporting the aforementioned parts is joined to the panel 14 using techniques known in the art. Referring to FIGS. 2, 3, and 5–7, the assembler is ready to join the panel 14 to the frame 12. The alignment pins 34 are placed within the holes 31, which allows the panel 14 to be positioned relative to the frame 12. When the assembler moves the panel 14 toward the frame 12 along the z-axis, the holder 40 comes into contact with the male connectors 29.

The chamfered edges of the wall structure guide each male connector 29 into the channel 100 at the first end 102. However, alignment may require movement of the female connector 42 along the x-axis, y-axis, or z-axis. Movement of the female connector along the x-axis or the y-axis requires movement of the holder 40 with respect to the base 37. Movement along the x-axis causes the holder 40 to compress the springs 38. Movement along the y-axis causes the spring projection to ride along the indentation 125. The geometry of the indentation 125 assures that the spring projection 87 returns the valley 130 on the platform and never exits the indentation 125. Thus, this arrangement allows the holder 40 to self-align with the male connectors 29 until the male connector 29 enters the channel 100. And the holder 40 is always forced toward the centered position within the base 37.

Referring to FIGS. 6 and 2, the panel 14 is moved toward the frame 12, the male connector 29 contacts the female connector 42 in zone A. Once a connector mating force is exceeded, the tabs 146 enter the holes 158, and the connectors 29 and 42 are held together. At this point the terminals within the connectors are fully engaged.

The assembler continues to apply force on the panel 14, until a retainer assembly force is exceeded. Once this force is exceeded, the female connector ridge 140 forces the legs 108 to flex outward so that the ridge 140 passes the ridge 116, and the female connector 42 enters zone B. In zone B, the female connector 42 is free to move along the z-axis as needed. However, the interface between the ridge 140 and the ridge 116 prevents the female connector 42 from leaving zone B. Thus, the panel 14 is secured to the frame 12 and all the electrical connections have been made.

Referring to FIGS. 2, 3, and 6 during operational movement of the vehicle and even opening and closing of the door, the panel 14 may experience a relative movement or deformation especially with respect to the frame 12. The door's connector separation force is the force required to unlatch the male connectors 29 from the female connectors 42. The retainer detachment force is the force required to remove the female connector 42 from zone B of the holder 40. The connector separation force is greater than the retainer detachment force. Both these forces are greater than those encountered during vehicle operation. Thus, as a result of the connection system 32, the panel 14 can move in the x-direction, y-direction and z-direction during vehicle operation without affecting the connectors. Movement along the x-axis and the y-axis Referring to FIG. 2, in order to remove the panel 14 for repair or inspection of the connectors, the panel 14 must be separated from the frame 12. The panel is pulled apart from the frame 12. The force applied must release the fasteners 42 from the holes 31. The retainer detachment force will be exceeded before the connector separation force.

Once the retainer detachment force is exceeded, the leg 108 flexes outward and the ridge 140 passes over ridge 116. Thus, the female connector 42 returns to zone A, before the connectors 29 and 42 separated. As a result, the female connector 42 and the wiring associated therewith remain connected to the panel 14. The female connector 42 is prevented from exiting the holder 40 due to engagement of the ridges 138 with the ends of the grooves 112 (as shown in FIGS. 3 and 4). If the connector separation force was less than the retainer connector force, the connector would separate while the female connector ridge 140 is in zone B.

As the panel 14 is further separated from the frame 12, the connector separation force is exceeded because the male connector 29 is fixed to the panel and the female connector fixed within the holder. As a result, the female and male connectors 29 and 42 separate. The holder 40 can be slid from engagement with the base 37. Referring to FIG. 3, during removal of the holder 40 from the base 37 the springs 38 flex outward allowing the holder 40 to be disengaged from the base. The female connectors 42 can be slid from engagement with the holder 40. The wire dress 44 can be removed and the necessary repairs can be performed.

Referring to FIG. 7, base 137 and springs 138 have been modified. The parallel side walls 152 include transversely extending slots 200. The remaining side wall 201 includes the C-shaped wall structure 202 and projections (not shown) for securing the springs 138 to the base 137. The springs 138 have been modified so that each spring has a substantially L-shaped portion 206 integrally formed with the curved portion 208. When the springs are attached to the base 137, the free end of the L-shaped portion 206 extends through the C-shaped wall structure 202, and the curved portion 208 extends through the slots 200 into the cavity 154 within the base. Operation of the base 137 and springs 138 is similar to that discussed above.

The principal advantage of the connection systems is that the panel can be easily attached to the frame, and although the operator cannot see the connectors, a good connection is achieved without pulling, damaging or cutting the wires. This advantage is due to the connection system allowing the connectors to move in three directions during installation of the panel.

Another advantage of the present invention is that during operation of the vehicle noise due to movement of the connectors is minimized. Noise is minimized because the connectors cannot move into contact with the panel or frame during operation. If the panel needs to adjust in the z-direction the female connector moves within zone B of the holder.

Yet another advantage is that the assembly time required to connect a panel to a frame is significantly decreased. This assembly time is reduced to the time it takes to position the panel with respect to the frame and snap the panel into place. Once the fasteners are secured within the frame the connection has been achieved.

While a particular invention has been described with reference to illustrated embodiments, various modifications of the illustrative embodiments, as well as additional embodiments of the invention, will be apparent to persons skilled in the art upon reference to this description without departing from the spirit and scope of the invention, as recited in the claims appended hereto. Various male and female connectors may be used with the present invention. Another modification includes the springs being integrally formed with the holder, so that the springs are flexible legs which extend outwardly from the platform at 45° angles from one another. It is therefore contemplated that the appended claims will cover any such modification or embodiments that fall within the true scope of the invention.

We claim:

1. A connection system for mating and aligning a first and a second connector, said first connector including transversely extending connector ridges on opposite sides thereof, said system comprising:

a holder for housing a first of said connectors, said holder having means for permitting said first connector to move along a first axis relative to said holder, if a predetermined mating force is exerted thereupon;

a base having a cavity for holding said holder, said cavity being dimensioned to permit said holder to move along a second and third axis, said second and third axes being perpendicular to said first axis;

two flexible springs each of said spring including a rounded projection, said springs being disposed with said cavity such that said rounded projections are spaced apart; and said holder further including a platform including two edges on opposite side of the platform each of said edges including a rounded indentation, upon insertion of said holder in said cavity each rounded projection mates with the associated rounded indentation; and a wall structure integrally formed to extend from said platform, said wall structure including a channel for receiving said first connector and two opposed side walls having a movable leg having a transversely extending leg ridge; said leg ridge divides said channel into a first zone and a second zone, when said first connector is within said first zone said first connector cannot move along said first axis, when said first connector is within said second zone said first connector can move along said first axis, if said predetermined mating force is exerted thereupon said connector ridges engage said leg ridges causing said legs to flex outward allowing said first connector to move between said first zone and second zone.

2. The connection system of claim 1, wherein said springs are formed from metal.

3. A connection system for mating and aligning a first and a second connector, said first connector including transversely extending connector ridges on opposite sides thereof, said system comprising:

a holder for housing a first of said connectors, said holder including a platform including two edges on opposite sides of the platform; each of said edges including a rounded indentation;

a wall structure integrally formed to extend from said platform, said wall structure including a channel for receiving said first connector, and means for permit ting said first connector to move along a first axis relative to said holder, if a predetermined mating force is exerted thereupon;

a base having a cavity for holding said holder, said cavity being dimensioned to receive said platform and permit said holder to move along a second and third axis;

two flexible springs, wherein said springs are formed from metal each of said spring including a rounded projection, said springs being disposed within said cavity such that said rounded projections are spaced apart, upon insertion of said holder in said cavity each rounded projection mates with the associated rounded indentation;

said wall structure further includes two opposed side walls having a movable leg having a transversely extending leg ridge; said leg ridge divides said channel into a first zone and a second zones when said first connector is within said first zone said first connector cannot move along said first axis, when said first connector is within said second zone said first connector can move along said first axis, if said predetermined mating force is exerted thereupon said connector ridges engage said leg ridges causing said legs to flex outward allowing said first connector to move between said first zone and second zone.

4. A connection system comprising:

a connector having a transversely extending ridge on a side thereof; and a holder having a wall structure for receiving the connector, the wall structure including a channel and a side wall, the side wall including a movable leg having a leg ridge, said leg ridge dividing the channel into a first zone and a second zone, wherein when the connector is within the first zone the connector cannot move along a first axis, and when the connector is within the second zone the connector can move along the first axis, and if a predetermined force is exerted on the connector the connector of the holder engages the leg connector to cause the leg to flex outwardly allowing the connector to move between the first and second zones.

5. The connection system specified in claim 4 including a base having a cavity for holding the holder, the cavity being dimension to receive the holder and permit the holder to move along a second axis and a third axis.

6. The connection system specified in claim 5 including two flexible springs disposed with the cavity of the base for retaining the holder on the base.

7. The connection system specified in claim 6 wherein each spring includes a rounded indentation that mate with a complementary rounded indentation formed on the holder.

8. The connection system specified in claim 4 including a second connector aligned by the holder and mated to the first connector.

* * * * *